US007568651B2

(12) United States Patent
Kessler

(10) Patent No.: US 7,568,651 B2
(45) Date of Patent: Aug. 4, 2009

(54) CORRECTION OF LOOSELY WOUND LABEL ROLLS

(75) Inventor: Leonard Kessler, Reading, OH (US)

(73) Assignee: Graphic Packaging International, Inc., Marietta, GA (US)

( * ) Notice: Subject to any disclaimer, the term of this patent is extended or adjusted under 35 U.S.C. 154(b) by 336 days.

(21) Appl. No.: 11/467,287

(22) Filed: Aug. 25, 2006

(65) Prior Publication Data

US 2008/0048060 A1 Feb. 28, 2008

(51) Int. Cl.
*B65H 23/18* (2006.01)

(52) U.S. Cl. ..... 242/418.1; 242/419.1; 242/413.3; 242/417.3

(58) Field of Classification Search ... 242/413.1–413.4, 242/417.1–417.3, 418.1, 419.1–419.3; 226/44, 226/118.3

See application file for complete search history.

(56) References Cited

U.S. PATENT DOCUMENTS

| | | | | |
|---|---|---|---|---|
| 3,851,832 | A | 12/1974 | Krueckels et al. | |
| 4,159,808 | A * | 7/1979 | Meihofer | 242/413.1 |
| 4,535,949 | A | 8/1985 | Olsson | |
| 4,958,782 | A | 9/1990 | Dannatt et al. | |
| 5,196,082 | A | 3/1993 | Randolph | |
| 5,480,085 | A * | 1/1996 | Smithe et al. | 226/44 |
| 5,642,865 | A * | 7/1997 | Fell et al. | 242/334.6 |
| 5,741,381 | A | 4/1998 | Dolence et al. | |
| 5,825,374 | A * | 10/1998 | Albertalli et al. | 346/136 |
| 5,849,143 | A | 12/1998 | Ingalls | |
| 5,887,076 | A | 3/1999 | Takahashi et al. | |
| 6,471,152 | B1 * | 10/2002 | Suzuki et al. | 242/417.3 |
| 6,527,888 | B2 | 3/2003 | Williams et al. | |
| 6,547,707 | B2 * | 4/2003 | Cote | 493/13 |
| 6,616,084 | B1 | 9/2003 | Sitzmann | |
| 6,629,663 | B1 | 10/2003 | Bettendorf | |
| 6,824,032 | B2 * | 11/2004 | Kumatori | 226/36 |
| 6,875,304 | B2 | 4/2005 | Schanke et al. | |
| 7,438,251 | B2 * | 10/2008 | St. Germain et al. | 242/417.3 |
| 2002/0005254 | A1 | 1/2002 | Williams et al. | |
| 2003/0034375 | A1 * | 2/2003 | Kumatori | 226/118.2 |
| 2004/0206449 | A1 | 10/2004 | Schanke et al. | |
| 2005/0029391 | A1 | 2/2005 | Cocciadiferro et al. | |

* cited by examiner

*Primary Examiner*—Sang Kim
(74) *Attorney, Agent, or Firm*—Womble Carlyle Sandridge & Rice, PLLC

(57) ABSTRACT

In one aspect, a method of correcting a loosely wound supply roll to be used with a label applying machine is described. The method includes providing a supply roll having a material web wound thereon, the supply roll mounted on a supply roll spindle such that the material web is aligned with an intake of a labeling mechanism on the label applying machine. The method further includes mounting a moveable web guide to apply pressure to the material web being supplied to the labeling mechanism, wherein the web guide includes an encoder. The method further includes determining the tension of the material web wound around the supply roll using the movable web guide and the encoder. Further still, the method includes adjusting the tension of the material web wound around the supply roll if the material web is determined to be too loosely wound about the supply roll to provide adequate tension to the web as the web leaves the supply roll.

28 Claims, 5 Drawing Sheets

CORRECTION OF LOOSELY WOUND LABEL ROLLS

BACKGROUND OF THE INVENTION

This invention relates generally to label application machinery, and more specifically to systems and methods of testing for a loosely wound supply roll and correcting a loosely wound supply roll.

Label rolls produced by manufactures can be wound very loosely anywhere within the roll. This looseness prevents the label application machinery from either calculating an accurate starting diameter of a label roll, or providing adequate web tension to the label roll. Inadequate web tension of the label roll can inhibit control of the label roll. When a label application machine inaccurately calculates the starting diameter of a label roll, or when inadequate web tension is present, the label application machine shuts down. This causes excessive and unacceptable downtime and waste in the form of unusable rolls of material.

BRIEF DESCRIPTION OF THE INVENTION

In one aspect, a method of correcting a loosely wound supply roll to be used with a label applying machine is provided. The method includes providing a supply roll having a material web wound thereon, the supply roll mounted on a supply roll spindle such that the material web is aligned with an intake of a labeling mechanism on the label applying machine. The method further includes mounting a moveable web guide to apply pressure to the material web being supplied to the labeling mechanism, wherein the web guide includes an encoder. The method further includes determining the tension of the material web wound around the supply roll using the movable web guide and the encoder. Further still, the method includes adjusting the tension of the material web wound around the supply roll if the material web is determined to be too loosely wound about the supply roll to provide adequate tension to the web as the web leaves the supply roll.

In another aspect, an apparatus for correcting a loosely wound supply roll to be used with a label applying machine is provided. The apparatus includes a supply roll mounted on a supply roll spindle, the supply roll having a material web wound thereon. The apparatus also includes a motor mechanically coupled to the supply roll spindle. The apparatus further includes an angular feedback device including an encoder, wherein the angular feedback device is configured to measure a displacement of a dancer roller. The apparatus further includes a processor configured to test the tension of the material web wound around the supply roll using the dancer roller and the angular feedback device, and the processor configured to adjust the tension of the material web wound around the supply roll if the material web is determined to be too loosely wound around the supply roll.

In yet another aspect, a computer program embodied on a computer readable medium for testing and correcting a supply roll of material is provided. The program includes at least one code segment that prompts a user to initiate a test method, at least one code segment that provides a motor with a direction and amount in which to rotate, at least one code segment that determines a tension of a material web wound around the supply roll, and at least one code segment that prompts a start of a tension adjusting computer code if the material web is determined to be too loosely wound around the supply roll.

DETAILED DESCRIPTION OF THE INVENTION

A method and an apparatus for determining whether a material web is loosely wound around a supply roll are described herein. In addition, a method and an apparatus for tightening the material web around the supply roll are described herein. The present invention is described below in reference to its application in connection with and operation of an apparatus for providing a material web. The web includes a continuous web of printed or non-printed labels coupled in a serial configuration from a supply roll located upon a spindle supported by a support stand to a label applying mechanism. It will be apparent to those skilled in the art and guided by the teachings herein provided that the invention is likewise applicable to any apparatus and/or method for feeding suitable web materials.

Figure 1:
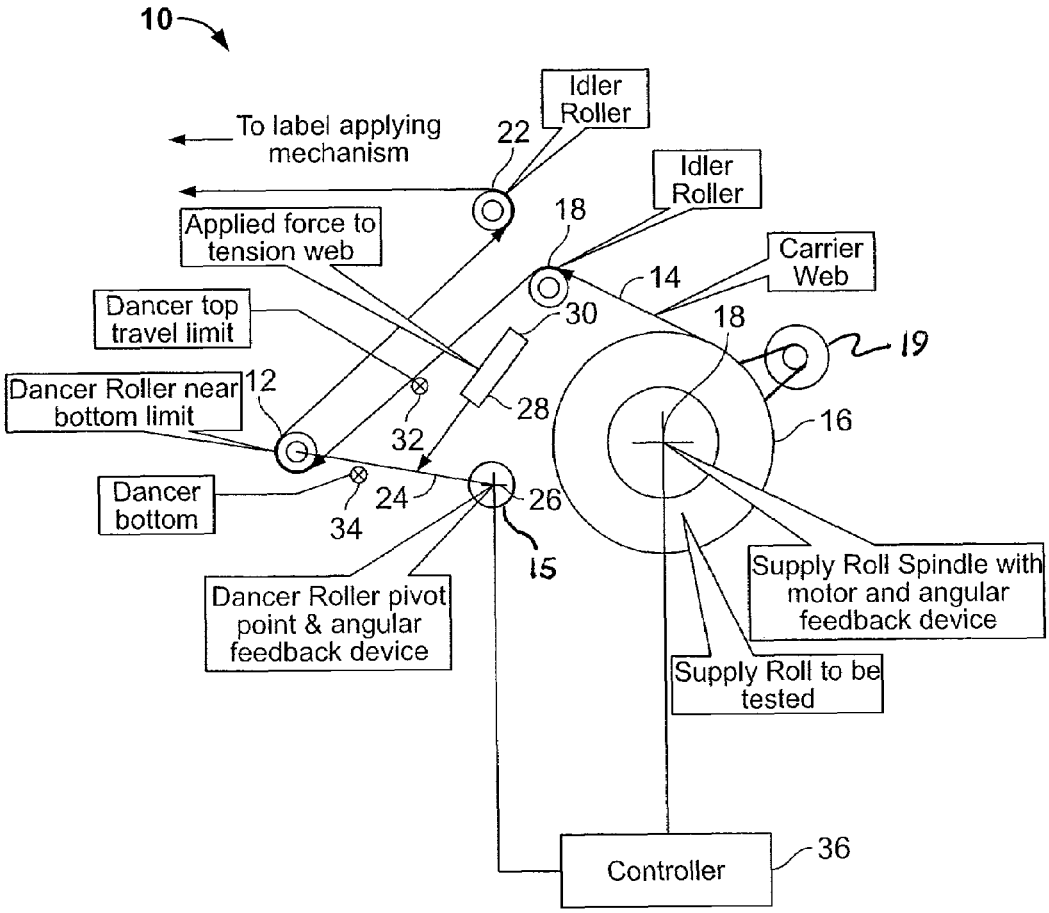
FIG. 1 is a schematic diagram of a label applying machine having a web guide roller near a bottom limit in accordance with one embodiment of the invention.

Referring now to the figures, FIG. 1 is a schematic illustration of a label applying machine 10 having a web guide 12. More specifically, FIG. 1 is an illustration of machine 10 configured to guide a material web 14 from a supply roll 16 to a label applying mechanism (not shown). Supply roll 16 is mounted on a supply roll spindle 18 that can be selectively rotated by a motor 19 mechanically coupled to the spindle. Material web 14 is wound around supply roll 16. Material web 14 is threaded around a first idler roller 18, web guide roller 12, and a second idler roller 22 before reaching the label applying mechanism. Web guide roller 12, also known as a dancer roller or supply roll dancer web guide roller, is connected to an arm 24 that is connected to a pivot pin 26 and an angular feedback device and encoder 15. A pressure supplying device 28, for example, an air cylinder, is attached to web guide arm 24 at a first end and is fixed to machine 10 at second end 30. Pressure supply device 28 exerts a force on web guide arm 24, which exerts a force on material web 14 to maintain a desired level of web tension at supply roll spindle 18. Web guide arm 24 moves between an upper web guide motion limit 32 and a lower web guide motion limit 34.

Figure 2:
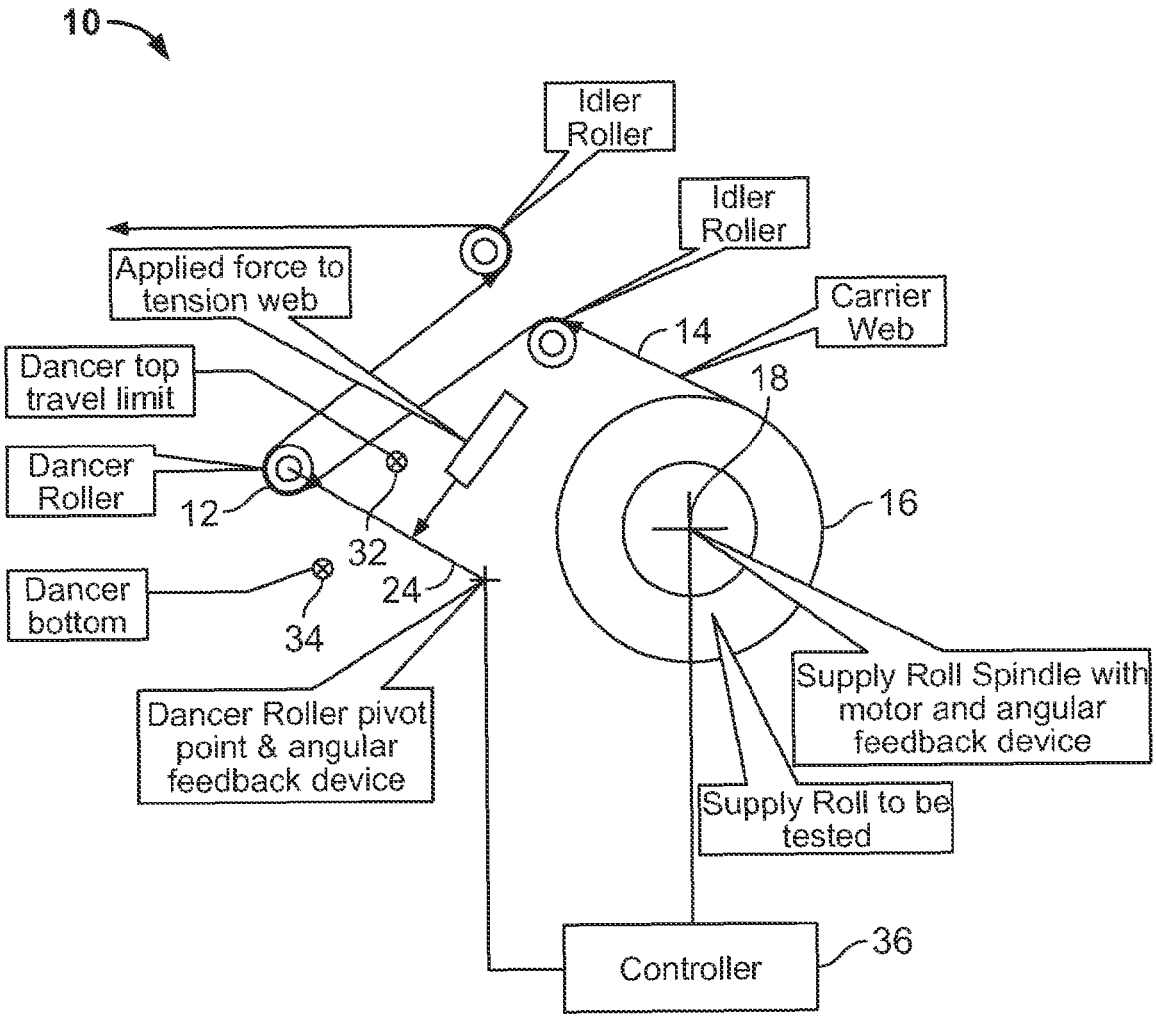
FIG. 2 is a schematic diagram of the label applying machine shown in FIG. 1 having the web guide roller near mid-travel in accordance with one embodiment of the invention.

FIG. 2 is a schematic diagram of label applying machine 10 having web guide 12 located near a mid-travel position. Web guide 12, and therefore web guide arm 24, are positioned approximately midway between upper web guide motion limit 32 and lower web guide motion limit 34. Supply roll spindle 18 is provided with instructions from a motion controller/processor 36 to rotate in a direction that should pull web material back onto supply roll 16. For the embodiment of FIG. 2, a clockwise rotation pulls web material back onto supply roll 16. Under normal operating conditions, and with a tightly wound label roll, web guide 12 changes position in response to the clockwise rotation of spindle 18. If material web 14 is wound too loosely around supply roll 16, rotation of supply roll spindle 18 in a direction that should pull web material back onto supply roll 16 will not cause a change in the position of web guide 12. Alternatively, if material web 14 is wound too loosely around supply roll 16, rotation of supply roll spindle 18 in a direction that should pull web material back onto supply roll 16 will cause a change in the position of web guide 12 to occur at a lower rate than expected.

Supply roll spindle 18 is connected to a servo or stepper motor (not shown) with a position feedback device (not shown). The motor and feedback device are connected to motion controller/processor 36. Controller 36 is a device capable of controlling the movement and position of the motor. Controller 36 is programmable. As controller 36 instructs stepper motor (not shown) to rotate supply roll spindle 18 a fixed amount, angular feedback device and encoder (not shown) provides controller 36 with information on the movement of web guide 12.

Figure 3:
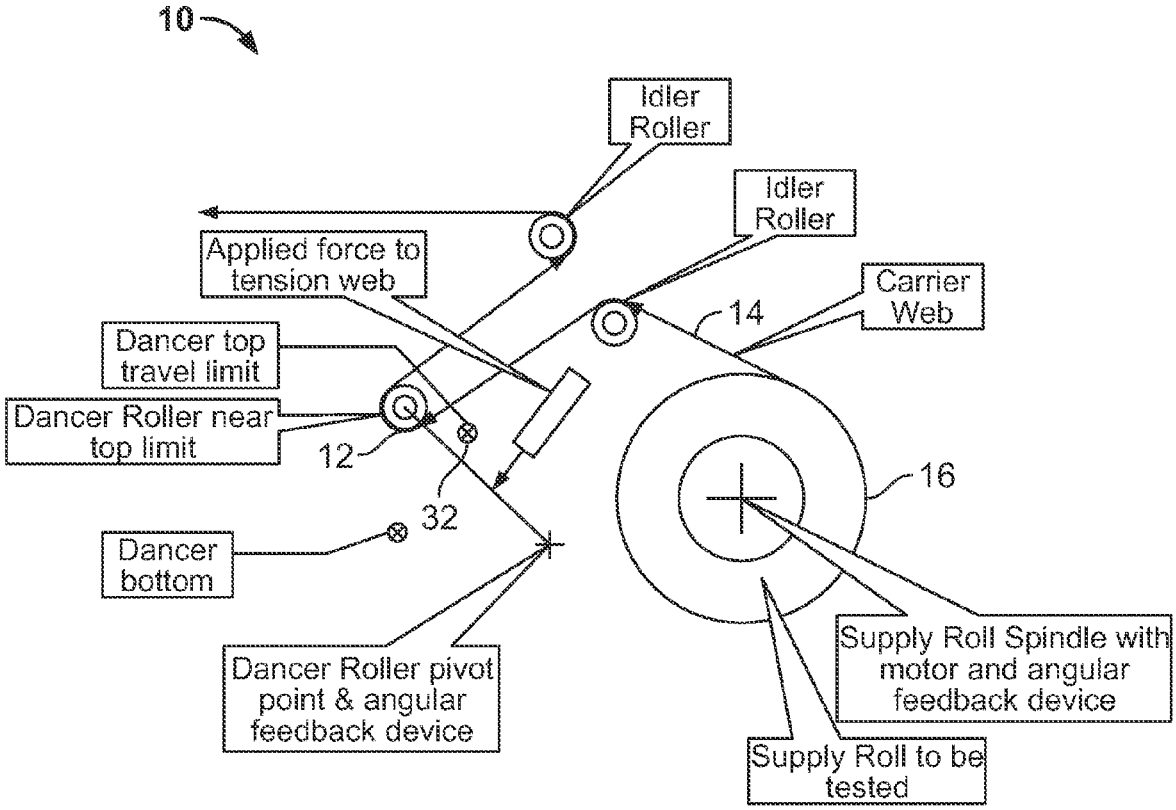
FIG. 3 is a schematic diagram of the label applying machine shown in FIG. 1 having the web guide roller near a top limit in accordance with one embodiment of the invention.

FIG. 3 is a schematic diagram of label applying machine 10 having web guide 12 located near an upper-travel position. Web guide 12, and therefore web guide arm 24, are positioned near upper web guide motion limit 32.

Figure 4:
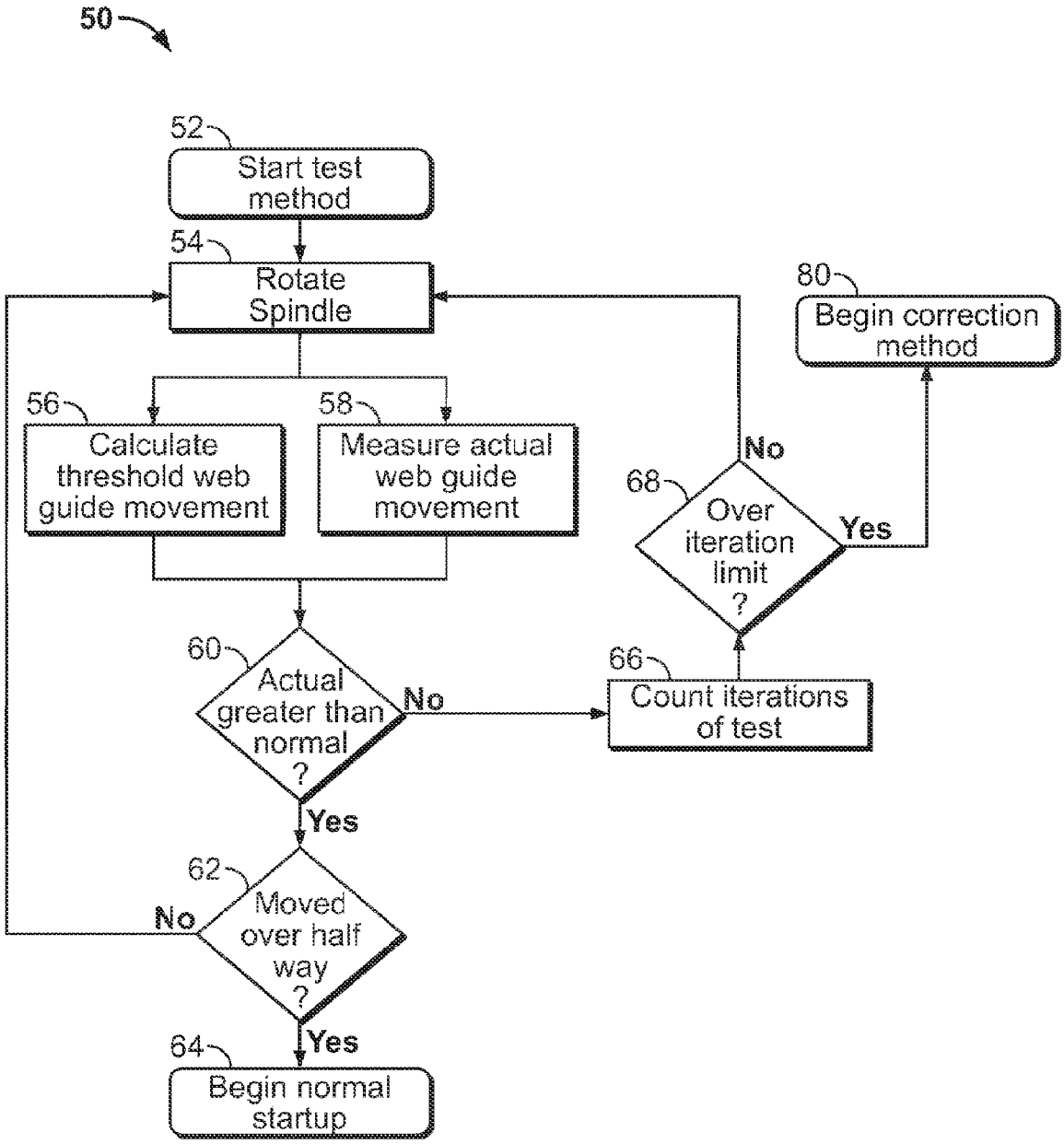
FIG. 4 is an exemplary embodiment of a flow chart illustrating a method of testing the windings of a supply roll.

FIG. 4 is an exemplary embodiment of a flow chart illustrating a method of testing the windings of a supply roll. Prior to beginning test method 50, supply roll 16 and material web 14 are configured to be fed to the label applying mechanism. Test method 50 enables controller 36 to determine the amount of slack within supply roll 16 to determine whether supply roll 16 is sufficiently wound to provide a suitable material web tension for proper operation of the label applying mechanism. Test method 50 typically begins upon a command from controller 36 to the motor (not shown) mechanically coupled to supply roll spindle 18. This command from controller 36 instructs the motor to rotate 54 supply roll spindle 18, and therefore supply roll 16, a first fixed amount in a direction that pulls material web 14 onto supply roll 16. In one embodiment, prior to rotating 54 spindle 18, a measurement of the diameter of supply roll 16 is performed, for example, by an ultrasonic sensor.

Rotating 54 spindle 18 in a direction that pulls material web 14 onto supply roll 16 has the effect of applying a force to web guide 12, causing web guide 12 and arm 24 to move from a lower web guide motion limit 34 toward upper web guide motion limit 32. Calculating a threshold web guide displacement 56 consists of configuring controller 36 to calculate a threshold web guide displacement, corresponding to a tightly wound supply roll, within a range of supply roll diameters, for a given supply roll spindle rotation 54. Measuring an actual web guide displacement 58 includes configuring the angular feedback device (not shown), attached to arm 24, to provide controller 36 with an actual displacement of web guide 12.

Test method 50 includes programming controller 36 to compare 60 actual web guide displacement 58 to calculated threshold web guide displacement 56. If actual web guide displacement 58 is equal to or greater than calculated threshold web guide displacement 56, and web guide 12 has moved past a mid-travel position 62 (see FIG. 2 for approximate location of a mid-travel position), the supply roll is considered to be acceptable and the label applying machine begins a normal startup procedure 64.

If actual web guide displacement 58 is equal to or greater than calculated threshold web guide displacement 56, and web guide 12 has not moved past a mid-travel position 62 (see FIG. 2 for approximate location of a mid-travel position), controller 36 re-starts test method 50.

If actual web guide displacement 58 is less than calculated threshold web guide displacement 56, this constitutes a first iteration of a failed test. Controller 36 counts the number of failed tests 66. Controller 36 is provided with a pre-set upper limit of failed test iterations by a user. If the pre-set upper limit of failed test iterations is not reached 68, controller 36 is configured to re-start test method 50. If the pre-set upper limit of failed test iterations is reached 68, controller 36 initiates a correction method 80.

Figure 5:
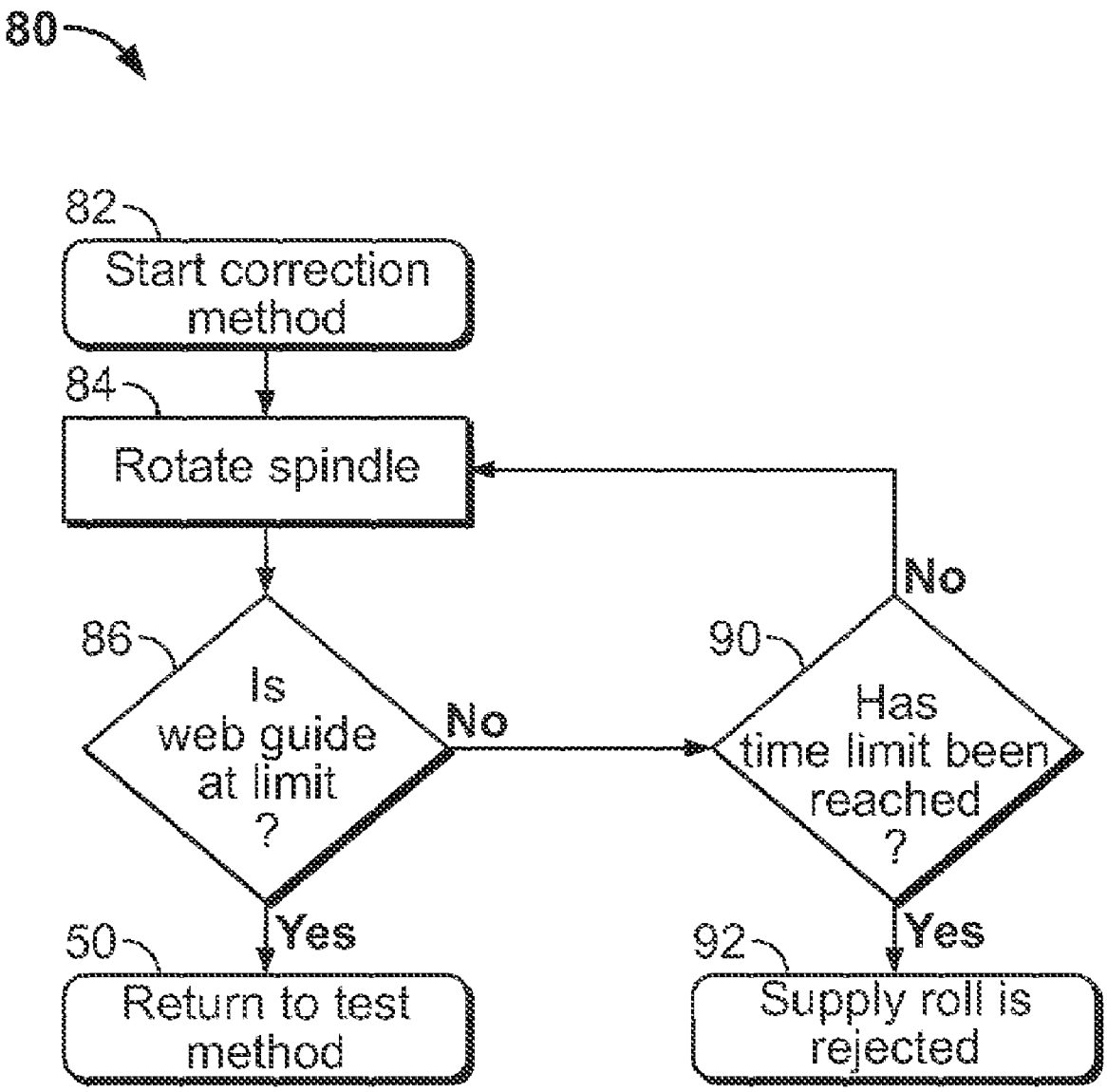
FIG. 5 is an exemplary embodiment of a flow chart illustrating a method of correcting the windings of a supply roll.

FIG. 5 is an exemplary embodiment of a flow chart illustrating correction method 80 to correct the windings of a supply roll, such as supply roll 16 shown in FIG. 1. Correction method 80 reduces the level of slack within supply roll 16 after test method 50 determines correction is necessary and that supply roll 16 is not adequately wound for proper operation of the labeling machine. Correction method 80 typically begins 82 upon a command from controller 36 after test method 50 reaches a set number of failed test iterations 68. This command from controller 36 instructs the motor to continuously rotate 84 supply roll spindle 18, and therefore supply roll 16, in a direction that pulls material web 14 onto supply roll 16. Controller 36 also starts a timer, counting toward a set time limit for correction method 80. In one embodiment, prior to rotating 84 spindle 18, a measurement of the diameter of supply roll 16 is taken, for example, by an ultrasonic sensor.

Rotating 84 spindle 18 in a direction that pulls material web 14 onto supply roll 16 has the effect of applying a force to web guide 12, causing web guide 12 and arm 24 to move from lower web guide motion limit 34 toward upper web guide motion limit 32. The angular feedback device (not shown) attached to arm 24 provides controller 36 with data indicating the displacement of web guide 12. Once web guide 12 reaches a position 86 near upper web guide motion limit 32 (see FIG. 3), controller 36 reverses the direction of rotation of spindle 18 until web guide 12 nears the lower travel limit 34. Test method 50 is then restarted.

If web guide 12 has not reached a position 86 near upper web guide motion limit 32, controller 36 continues to count toward a time limit. This time limit is provided to controller 36 by a user. If this time limit is reached 90, controller 36 indicates that supply roll 16 is unsuitable for use and is rejected 92. Setting time limit 90 prevents the labeling machine from being indefinitely tied up in test method 50 and correction method 80.

In one embodiment, a computer program is provided to controller 36. The program is embodied on a computer readable medium and utilizes a Structured Query Language (SQL) with a client user interface front-end for administration and a web interface for standard user input and reports. In an example embodiment, the system is web enabled and is run on a business-entity intranet. In another embodiment, the system is fully accessed by individuals having an authorized access outside the firewall of the business-entity through the Internet. In a further example embodiment, the system is run in a Windows® NT environment (Windows is a registered trademark of Microsoft Corporation, Redmond, Wash.). The application is flexible and designed to run in various different environments without compromising any major functionality.

The systems and processes are not limited to the specific embodiments described herein. In addition, components of each system and each process can be practiced independent and separate from other components and processes described herein. Each component and process also can be used in combination with other assembly packages and processes.

The computer program embodied on a computer readable medium for testing and correcting supply roll 16 prompts a user to initiate test method 50. The computer program includes computer code that corresponds to the steps of test method 50 including, providing the motor with a direction and amount in which to rotate 54, calculating a threshold web guide movement corresponding to the provided motor rotation 56, comparing the calculated threshold web guide movement to an actual web guide movement 60 provided to the computer program by an encoder 58, monitoring the actual displacement of the web guide 62, counting iterations of fixed supply roll rotations 68, and either beginning a normal label applying machine setup procedure 64, or prompting a start of correction method 80 if material web 14 is determined to be too loosely wound around supply roll 16.

The computer program embodied on a computer readable medium for testing and correcting supply roll 16 also includes computer code that corresponds to the steps of correction method 80. These steps include instructing the motor to continuously rotate the spindle 84, monitoring the web guide movement 86, and maintaining a count 90 of the length of correction method 80. The computer program is provided with an upper time limit for correction by a user. The computer program reverts back to the computer code corresponding to test method 50 when web guide 12 reaches an upper limit of web guide movement. The computer program provides a user with an indication that supply roll 16 is rejected 92 if the upper time limit for correction passes prior to web guide 12 reaching an upper limit of web guide movement 86.

While the invention has been described in terms of various specific embodiments, those skilled in the art will recognize that the invention can be practiced with modification within the spirit and scope of the claims.

What is claimed is:

1. A method of correcting a loosely wound supply roll to be used with a label applying machine, said method comprising:

providing a supply roll having a material web wound thereon, the supply roll mounted on a supply roll spindle such that the material web is aligned with an intake of a labeling mechanism on the label applying machine;

mounting a moveable web guide to apply pressure to the material web being supplied to the labeling mechanism, wherein the web guide includes an encoder;

determining the amount of slack within the material web wound around the supply roll using the movable web guide and the encoder; and adjusting the amount of slack within the material web wound around the supply roll if the material web is determined to be too loosely wound about the supply roll to provide adequate tension to the web as the web leaves the supply roll.

2. A method in accordance with claim 1 wherein determining the amount of slack within the material web wound around the supply roll comprises rotating the supply roll spindle a fixed amount in a direction that pulls the material web onto the supply roll and comparing a displacement of the movable web guide to a predetermined threshold displacement.

3. A method in accordance with claim 2 wherein determining the amount of slack within the material web wound around the supply roll comprises configuring a processor to calculate a threshold web guide displacement, corresponding to a tightly wound supply roll, within a range of supply roll diameters, for a given supply roll spindle rotation.

4. A method in accordance with claim 3 wherein determining the amount of slack within the material web wound around the supply roll comprises configuring the web guide and the encoder to provide the processor with data relating to an actual web guide displacement.

5. A method in accordance with claim 2 wherein determining the amount of slack within the material web wound around the supply roll comprises programming a motion controller to apply a fixed supply roll spindle rotation to enable a comparison between an actual web guide displacement and a predetermined threshold web guide displacement.

6. A method in accordance with claim 2 wherein determining the amount of slack within the material web wound around the supply roll comprises repeating the step of rotating the supply roll spindle a fixed amount upon determining that the actual web guide displacement did not exceed the predetermined threshold web guide displacement.

7. A method in accordance with claim 1 wherein determining the amount of slack within the material web wound around the supply roll comprises configuring a processor to compare the actual web guide displacement and the predetermined threshold web guide displacement.

8. A method in accordance with claim 1 wherein determining the amount of slack within the material web wound around the supply roll comprises initiating normal execution of the startup routine of the labeling machine upon determining the actual web guide displacement exceeded the predetermined threshold web guide displacement.

9. A method in accordance with claim 1 wherein determining the amount of slack within the material web wound around the supply roll comprises counting the iterations of rotating the supply roll spindle a fixed amount and, upon reaching a predetermined number of iterations, initiating the step of adjusting the amount of slack within the material web wound about the supply roll.

10. A method in accordance with claim 1 wherein adjusting the amount of slack within the material web wound around the supply roll comprises rotating the supply roll spindle continuously in a direction that pulls the material web onto the supply roll.

11. A method in accordance with claim 1 wherein adjusting the amount of slack within the material web wound around the supply roll comprises monitoring the displacement of the movable web guide as the supply roll spindle is rotated.

12. A method in accordance with claim 1 wherein adjusting the amount of slack within the material web wound around the supply roll comprises stopping the spindle rotation upon reaching one of an upper limit of movable web guide motion and a set time limit.

13. A method in accordance with claim 1 wherein adjusting the amount of slack within the material web wound around the supply roll comprises stopping the spindle rotation upon reaching a predetermined threshold of web guide motion.

14. A method in accordance with claim 1 wherein adjusting the amount of slack within the material web wound around the supply roll comprises stopping the spindle rotation, and indicating the supply roll is unusable, upon reaching a set time limit.

15. An apparatus for correcting a loosely wound supply roll to be used with a label applying machine, said apparatus comprising:

a supply roll mounted on a supply roll spindle, said supply roll having a material web wound thereon;

a motor mechanically coupled to said supply roll spindle;

an angular feedback device including an encoder, said angular feedback device configured to measure a displacement of a dancer roller; and a processor configured to test the amount of slack within said material web wound around said supply roll using said dancer roller and said angular feedback device, and said processor configured to adjust the amount of slack within said material web wound around said supply roll if said material web is determined to be too loosely wound around said supply roll.

16. An apparatus according to claim 15 wherein a processor configured to test the amount of slack within said material web wound around said supply roll further comprises said processor configured to provide said motor with instructions to rotate said supply roll spindle a fixed amount in a direction that pulls said material web onto said supply roll and compare a displacement of said dancer roller to a predetermined threshold displacement.

17. An apparatus according to claim 16 wherein a processor configured to test the amount of slack within said material web wound around said supply roll further comprises said processor configured to calculate a threshold dancer roller displacement, corresponding to a tightly wound supply roll, within a range of supply roll diameters, for a given supply roll spindle rotation.

18. An apparatus according to claim 17 wherein a processor configured to test the amount of slack within said material web wound around said supply roll further comprises said angular feedback device and encoder configured to provide said processor with data relating to an actual dancer roller displacement.

19. An apparatus according to claim 16 wherein a processor configured to test the amount of slack within said material web wound around said supply roll comprises said processor configured to again provide said motor with instructions to rotate said supply roll spindle a fixed amount in a direction that pulls said material web onto said supply roll and compare a displacement of said dancer roller to a predetermined threshold displacement upon determining that the actual dancer roller displacement did not exceed the threshold dancer roller displacement.

20. An apparatus according to claim 15 wherein a processor configured to test the amount of slack within said material web wound around said supply roll comprises said processor configured to compare the actual dancer roller displacement and the threshold dancer roller displacement.

21. An apparatus according to claim 15 wherein a processor configured to test the amount of slack within said material web wound around said supply roll is further configured to initiate normal execution of a startup routine of the labeling machine upon determining the actual dancer roller displacement exceeded the threshold dancer roller displacement.

22. An apparatus according to claim 15 wherein a processor configured to test the amount of slack within said material web wound around said supply roll comprises said processor configured to count iterations of rotating said supply roll spindle a fixed amount, and, upon reaching a predetermined number of iterations, provide said motor with instructions to rotate said supply roll spindle to adjust the amount of slack within said material web wound around said supply roll.

23. An apparatus according to claim 22 wherein said processor configured to provide said motor with instructions to rotate said supply roll spindle further comprises said processor configured to provide said motor with instructions to continuously rotate said supply roll spindle in a direction that pulls said material web onto said supply roll.

24. An apparatus according to claim 15 wherein said processor configured to adjust the amount of slack within said material web wound around said supply roll if said material web is determined to be too loosely wound around said supply roll comprises said processor configured to monitor the displacement of said dancer roller.

25. An apparatus according to claim 15 wherein said processor configured to adjust the amount of slack within said material web wound around said supply roll if said material web is determined to be too loosely wound around said supply roll comprises said processor configured to stop the spindle rotation upon reaching one of an upper limit of dancer roller displacement and a set time limit.

26. An apparatus according to claim 15 wherein said processor configured to adjust the amount of slack within said material web wound around said supply roll if said material web is determined to be too loosely wound around said supply roll comprises said processor configured to stop the spindle rotation upon reaching a predetermined threshold of dancer roller displacement.

27. An apparatus according to claim 26 wherein said processor configured to stop the spindle rotation upon reaching a predetermined threshold of dancer roller displacement further comprises said processor configured to re-test the amount of slack within said material web wound around said supply roll.

28. An apparatus according to claim 15 wherein said processor configured to adjust the amount of slack within said material web wound around said supply roll if said material web is determined to be too loosely wound around said supply roll comprises said processor configured to stop the spindle rotation and indicate said supply roll is unusable, upon reaching a set time limit.

* * * * *